United States Patent [19]

Uchida et al.

[11] Patent Number: 4,787,539

[45] Date of Patent: Nov. 29, 1988

[54] ICE DISPENSER

[75] Inventors: Naoya Uchida; Hiroshi Kai, both of Toyoake, Japan

[73] Assignee: Hoshizaki Electric Co., Ltd., Toyoake, Japan

[21] Appl. No.: 64,122

[22] Filed: Jun. 19, 1987

[30] Foreign Application Priority Data

Jun. 19, 1986 [JP] Japan ..... 92486[U]
Jun. 19, 1986 [JP] Japan ..... 92487[U]
Jun. 19, 1986 [JP] Japan ..... 92488[U]

[51] Int. Cl.[4] ..... F25C 1/00; G01F 11/28

[52] U.S. Cl. ..... 222/639; 222/146.6; 222/452; 222/643; 62/137

[58] Field of Search ..... 222/52, 63–66, 222/638–641, 643, 146.1, 146.6, 239, 424.5, 425, 450, 476, 333, 504, 452; 62/66, 68, 137, 233, 344

[56] References Cited

U.S. PATENT DOCUMENTS

| | | | |
|---|---|---|---|
| 2,986,897 | 6/1961 | Howard | 62/137 |
| 3,211,338 | 10/1965 | Weil et al. | 222/643 |
| 3,441,176 | 4/1969 | Reynolds et al. | 222/640 |
| 4,060,183 | 11/1977 | Puurunen | 222/450 |
| 4,102,660 | 7/1978 | Beckett et al. | 62/344 |
| 4,227,377 | 10/1980 | Miller | 62/66 |
| 4,228,923 | 10/1980 | Barnard | 222/52 |
| 4,644,757 | 2/1987 | Hida et al. | 62/233 X |
| 4,679,715 | 7/1987 | Hovinga | 222/517 |

FOREIGN PATENT DOCUMENTS

| | | | |
|---|---|---|---|
| 677542 | 8/1952 | United Kingdom | 222/425 |

*Primary Examiner*—Michael S. Huppert
*Attorney, Agent, or Firm*—Wenderoth, Lind & Ponack

[57] ABSTRACT

An ice dispenser apparatus includes an ice making mechanism (1) and, an ice storage box (5) for storing ice pieces produced by the ice making mechanism. When the ice pieces are dispensed a discharge port shutter (9) normally closing a discharge port (5*c*) provided in the ice storage box (5) at a lower portion thereof is opened by a discharge port shutter actuator (11). A transient storage chamber (13) is provided in communication with the discharge port (5*c*), the chamber having a normally closed aperture for transiently storing a predetermined amount of ice pieces discharged from the ice storage box (5) through the discharge port (5*c*) when the discharge port shutter (9) is opened. A transient storage chamber shutter (10) is provided in association with the transient storage chamber (13) and is adapted to be actuated by a transient storage chamber shutter actuator (12) for selectively opening or closing the aperture. The discharge port shutter (9) and the transient storage chamber shutter (9) are opened and closed by the associated actuators (11, 12), respectively, in such a manner that the predetermined amount of ice pieces is temporarily stored once within the transient storage chamber (13) before being dispensed therefrom.

10 Claims, 10 Drawing Sheets

ICE DISPENSER

BACKGROUND OF THE INVENTION

1. Field of the Invention

The present invention relates generally to an ice dispensing apparatus equipped with an ice making mechanism and an ice storage box, and more particularly to the discharge of ice pieces from the ice storage box to which the ice pieces are supplied from the ice making mechanism.

2. Description of the Prior Art

There are various known types of ice dispensers. Most of the ice making mechanisms incorporated in such ice dispensers are of a so-called auger type in which an evaporator pipe is wound around an outer peripheral surface of a cylinder supplied with water for making ice, wherein an ice layer is produced on and along the inner surface of the cylinder under a cooling action produced by coolant flowing through the evaporator pipe. The ice layer thus formed is scraped off into ice shavings by means of a helical blade mounted around a rotatable shaft disposed within the cylinder, the resulting ice shavings being then fed upwardly to pass forcibly through a pressure head having a plurality of compression channels to be converted into ice columns which are then broken into small ice pellets or pieces having a desired length. The ice pieces thus produced are stored within an ice storage chamber or box disposed above the cylinder. The rotatable shaft mentioned above has a lower end portion operatively coupled to a drive motor and extends upwardly through the cylinder and the pressure head into the ice storage box, wherein the upper end portion of the rotatable shaft is coupled to an agitator assembly. An ice storage level sensing or detecting switch is installed within the ice storage box. When the ice storage box becomes full of ice pieces, this state is detected by the ice storage level switch, whereby a compressor constituting a part of the ice making mechanism and the drive motor for rotating the rotatable shaft are stopped.

In such an ice dispenser apparatus, when the ice pieces stored within the ice storage box are to be discharged, the drive motor is energized to rotate the agitator assembly and a discharge port shutter is actuated to open a discharge a port provided in a side wall portion of the ice storage box. Thus, an amount of small ice pieces is dispensed through the discharge port, which amount can be determined by the time period during which the discharge port shutter is maintained open.

The known ice dispenser apparatus is, however, disadvantageous in that since the amount of ice dispensed for a predetermined time through the discharge port having a fixed cross-sectional area may vary dependending on variable parameters such as quality of ice, shape of ice pieces and others, the amount of ice being dispensed differs significantly from one discharging another even when the period during which the discharge port shutter is opened is maintained constant. Furthermore, since unevenness or dispersion in the amount of ice as dispensed becomes more significant as the shutter release duration is increased, the uniform ice dispensing capability of the apparatus becomes even further degraded when the amount of ice dispensed at a time is increased.

SUMMARY OF THE INVENTION

Accordingly, it is a primary object of the present invention to provide an ice dispenser apparatus which is capable of suppressing the unevenness or dispersion in the dispensed amount of ice to a possible minimum.

In view of the above and other objects which will be more apparent as the following description proceeds, there is provided, according to an aspect of the present invention, an ice dispenser apparatus including an ice making mechanism and an ice storage box for storing ice pieces produced by the ice making mechanism, wherein when the ice pieces are discharged from the ice storage box, a discharge port shutter normally closing a discharge port provided in the ice storage box at a lower portion thereof is opened by a discharge port shutter actuating device. The apparatus further comprises a transient storage chamber (also referred to as the metering chamber) communicating with the discharge port and having a normally closed aperture for transiently storing a predetermined amount of ice pieces discharged from the ice storage box through the discharge port when the discharge port shutter is opened, and a transient storage chamber shutter provided in association with the transient storage chamber and adapted to be actuated by a transient storage chamber shutter actuating device for selectively opening or closing the aperture, wherein the discharge port shutter and the transient storage chamber shutter are opened and closed by the respective actuating devices in such a manner that a predetermined amount of ice pieces is temporarily stored once within the transient storage chamber before being disposed therefrom.

When ice is dispensed, the amount of ice to be dispensed is always determined by the volume of the transient storage (or metering) chamber. Accordingly, inconsistencies in the amount of ice dispensed can be reduced to a minimum even when the amount of ice discharged from the ice storage box varies due to changes in the ice quality and shape. Such unevenness in the amount of ice as dispensed can also be suppressed in an ice dispenser apparatus designed to dispense a large amount of ice by repeating the ice dispensing operation for a desired number of times in an automatic manner.

BRIEF DESCRIPTION OF THE DRAWINGS

In the course of the following detailed description, reference will be made to the attached drawings in which the same reference numerals denote the same or similar parts throughout the figures and in which.

DESCRIPTION OF THE PREFERRED EMBODIMENTS

Figure 1:
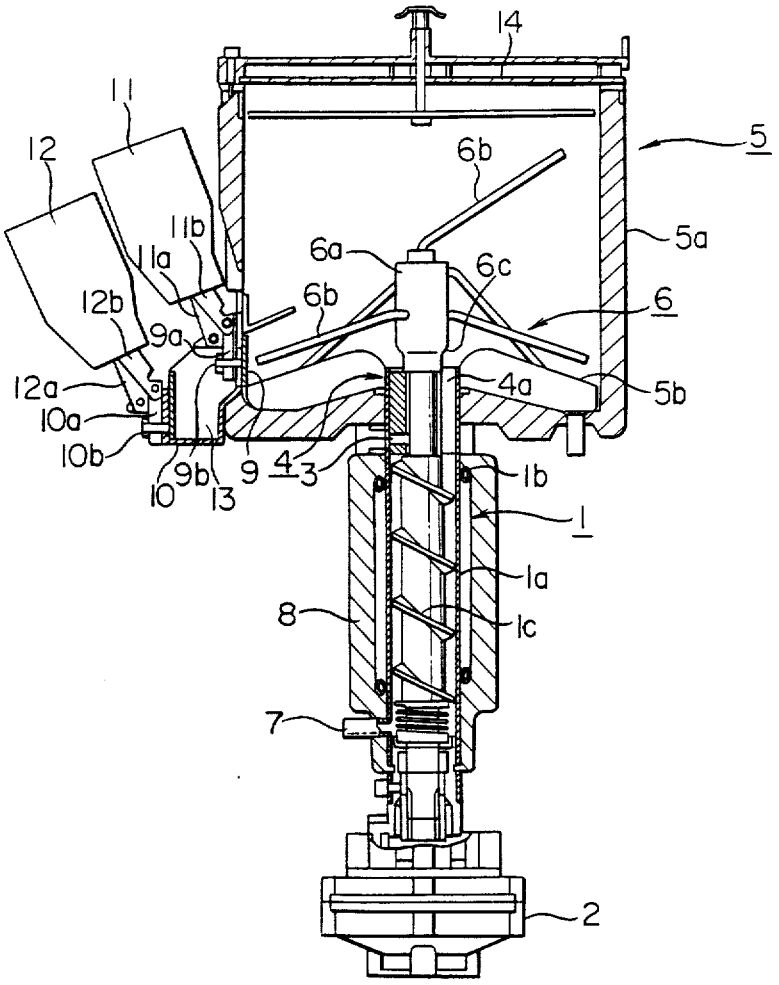
FIG. 1 is a vertical sectional view showing schematically an ice dispenser apparatus according to an embodiment of the present invention in a state in which a discharge port shutter and a metering chamber shutter are closed.
Figure 2:
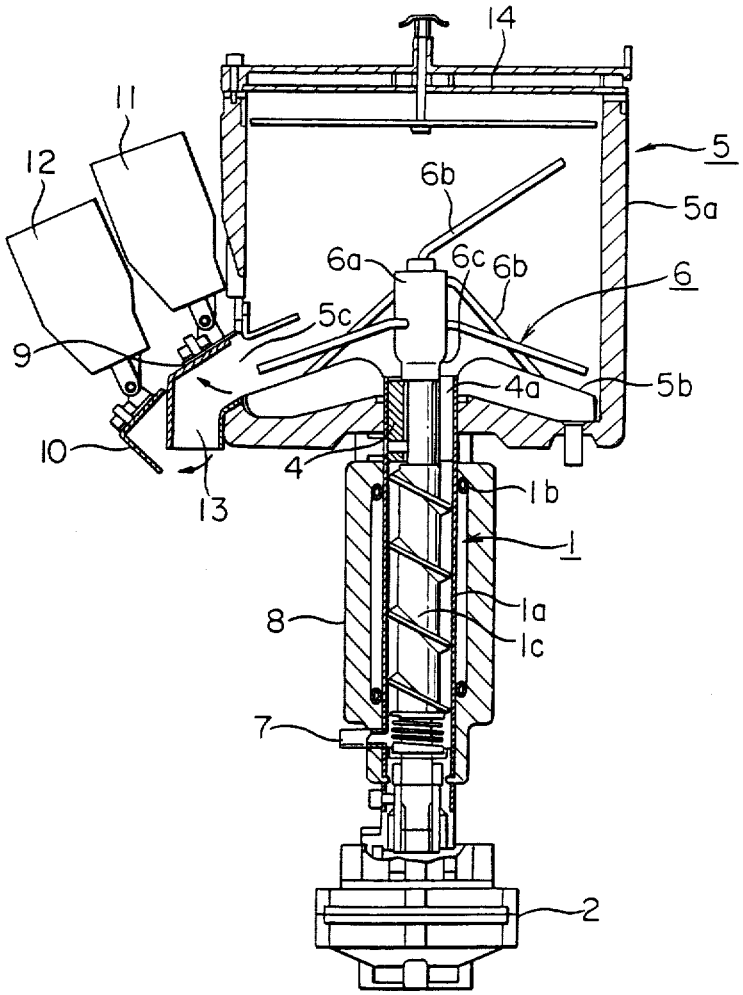
FIG. 2 is a vertical sectional view showing the ice dispenser apparatus of FIG. 1 in a state in which both the shutters are opened.

Referring to the drawings and in particular to FIGS. 1 and 2, there is shown an ice dispenser apparatus according to an embodiment of the present invention which is provided with an auger-type ice making mechanism generally denoted by reference numeral 1. The auger-type ice making mechanism 1 itself may be conventional and includes a vertically disposed hollow cylinder 1*a*, a vaporizing pipe 1*b* wound around the outer peripheral surface of the cylinder 1*a* and a rotatable auger 1*c* extending through the interior of the cylinder 1*a*. The auger 1*c* includes a rotatable shaft having a lower end portion coupled to a drive motor 2 and an intermediate enlarged portion which is formed with a helical tooth or blade, as can be seen in FIGS. 1 and 2. On the other hand, the upper end portion of the auger 1*c* extends upwardly through and beyond a pressure head 4 which is fitted within the cylinder 1*a* at the upper end portion thereof and which is fixedly secured by appropriate means such as screws 3. Also mounted on the cylinder 1*a* at the upper end thereof is a hollow ice storage box 5. The ice storage box 5 may preferably have a cylindrical configuration and is comprised of a heat-insulated wall member 5*a*. As will be seen in the figures, the upper end portion of the auger 1*c* extends into the interior of the ice storage box 5 and is equipped with a conventional agitator assembly 6 which includes a supporting base member 6*a* having a substantially cylindrical shape and a plurality of agitating rods 6*b* extending in various directions.

Extending through a heating insulating shell 8 and the cylinder 1*a* enclosed therein a water inlet tube 7 is mounted to and open within the cylinder 1*a* to supply water therein which is to be refrigerated into ice. More specifically, a coolant fed from a compressor (not shown) flows through the vaporizing pipe 1*b* to cool the cylinder 1*a*, whereby water within the cylinder 1*a* is deposited on the inner surface of the cylinder 1*a* in the form of an ice layer. As the auger 1*c* is rotated by the drive motor 2, the helical or spiral blade of the auger 1*c* scrapes the ice layer off of the inner surface of the cylinder. Ice shavings thus produced are fed toward the pressure head 4 and are compressed into ice columns during their passage through the head 4 under the action imparted by well known ice compressing passages 4*a* provided in the pressure head 4. The upper end portion of each ice column is fed upwardly from the associated compressing portion until it bears forcibly against a shoulder portion 6*c* of the supporting base member 6*a*, as the result of which the ice column is broken into ice pieces or pellets having a relatively small size to be subsequently placed on a draining board 5*b* disposed on the bottom of the ice storage box 5.

Mounted at the top of the ice storage box 5 is a vertically movable disc-type ice storage level detecting switch device 14. When the ice storage box 5 is filled with the ice pieces, this state of the ice storage box 5 is detected by the disc-type switch 14, whereby the drive motor 2 for the compressor (not shown) and the rotatable auger shaft of the ice making mechanism are stopped.

In order that the ice pieces stored within the ice storage box 5 can be discharged outwardly, a discharge or dispensing outlet port 5*c* having an appropriate size and shape (rectangular in cross section in the illustrated embodiment although it is not shown) is formed in the side wall member 5*a* of the ice storage box 5. Normally, this discharge port 5*c* is closed by an associated shutter 9 comprised of a plate member which is mounted on a supporting member 9*a* by means of pins 9*b*. The supporting member 9*a* in turn is pivotally connected to a shutter actuating bar 11*a* and a shutter locking bar 11*b* extending outwardly from a shutter open/close mechanism which may be comprised of any known structure. Additionally, the ice storage box 5 is provided with a volume metering device or chamber (which may also be referred to as a transient or temporary storage chamber) 13 having a box-like shape which encloses the peripheral edge portion of the rectangular ice piece discharge port 5*c* except for the upper edge portion thereof. More specifically, the top portion of the metering chamber 13 is cut out to define an opening or aperture which receives therein the discharging port shutter 9 when the latter is opened, as shown in FIG. 2. Additionally, the metering chamber 13 has a bottom aperture which is usually closed by a metering chamber shutter (which may also be referred to as the dispensing shutter) 10 which is comprised of a sheet member having a substantially L-like profile. The metering chamber shutter 10 is mounted on a supporting member 10*a* by means of pins 10*b*, which supporting member 10*a* in turn is pivotally connected to a shutter actuating bar 12*a* and a shutter locking bar 12*b* both extending from a shutter open/-close mechanism comprised of a known structure. Parenthetically, the ice dispenser apparatus according to the instant embodiment is shown in a state in which both the discharge port 9 and the metering chamber shutter 10 are closed in FIG. 1, while the apparatus is shown in FIG. 2 in state which both of the shutters are opened.

Figure 8:
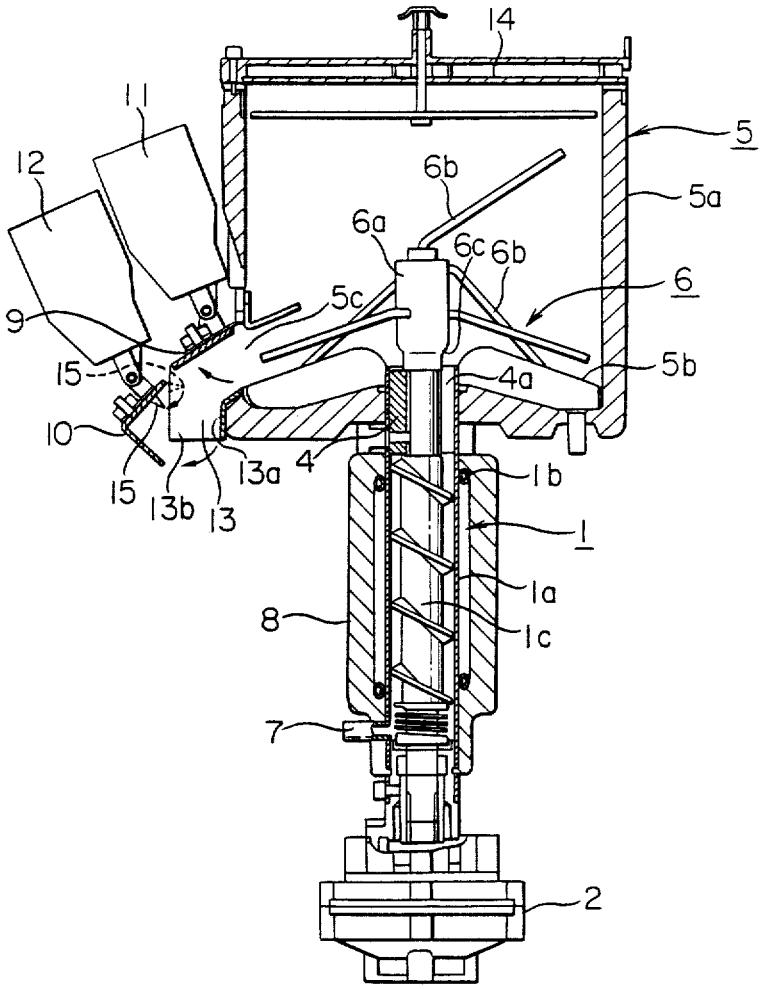
FIG. 8 is a vertical sectional view showing an ice dispenser apparatus according to a modified embodiment of the present invention.

A possible modification of the ice dispenser described above is shown in FIG. 8. More specifically, although the ice dispenser apparatus shown in FIG. 8 is the same as the one described above in that the metering chamber shutter 10 is comprised of the L-like plate member, the former differs from the latter in that the volume metering chamber 13 is realized by a bent rear wall 13*a* and a pair of opposite side walls 13*b* with the front wall being omitted, whereby an aperture is formed on the front side of the volume metering chamber 13 contiguous to the bottom aperture thereof. Due to this modified structure, the L-like metering chamber shutter 10 is designed to close and open not only the bottom aperture of the volume metering chamber 13 but also the front aperture thereof by means of an upstanding leg portion of the L-like sheet shutter member 10. As will be seen in FIG. 8, a wedge-like projection 15 is mounted on the upstanding leg portion of the L-like metering chamber shutter 10 in the vicinity of the upper edge thereof so as to extend into the metering chamber 13.

The modified structure of the ice dispenser apparatus shown in FIG. 8 is advantageous in that not only the bottom aperture but also the front aperture are opened upon opening of the metering chamber shutter 10 ensuring an increased size of the dispensing aperture in total, whereby the undesirable situation of the dispensing channel within the metering chamber 13 becoming partially jammed with ice pieces can be positively prevented. Thus, unevenness or variations in the amounts of ice dispensed can be reduced to a minimum. Furthermore, when the dispensing shutter 10 is opened, the projection 15 shown in FIG. 8 is rotated clockwise to press the ice pieces located within the metering chamber 13 downwardly to thereby assist in smoothly dispensing the ice pieces from the metering chamber (or transient storage chamber) 13.

Figure 3:
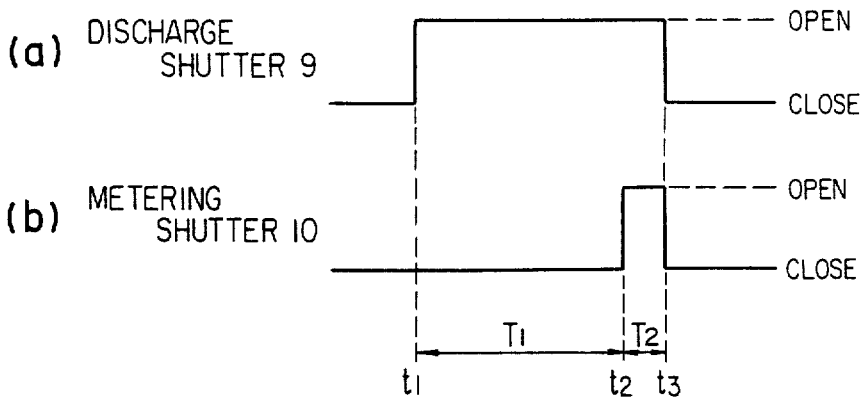
FIG. 3 shows a timing chart for illustrating operations of the discharge port shutter and the metering chamber shutter of the ice dispenser apparatus shown in FIG. 1.

Next, an ice discharging and dispensing operation of the ice dispenser apparatus described above will be elucidated by referrring to FIG. 3. Unless the ice storage box 5 is fully filled with the ice pieces, the drive motor 2 remains in the energized state to continuously rotate the agitator assembly 6. On the other hand, when the ice storage box 5 is full of ice pieces, the drive motor 2 is in the deenergized state with the agitator assembly 6 stopped. When a request for discharging the ice pieces from the ice storage box 5 occurs at a time point $t_1$, the drive motor 2 is started if it is at rest at that time period, whereby the agitator assembly 6 starts rotating. Simultaneously, the shutter open/close actuator 11 is activated to open the discharge port shutter 9 to allow a part of the ice pieces within the ice storage box to be discharged into the volume metering chamber 13 by way of the discharge port 5c, as is illustrated in FIG. 3 at (*a*). After the lapse of time long enough to allow the volume metering chamber 13 to be fully filled with the ice pieces, the metering chamber 10 is opened by the shutter open/close mechanism 12 at a time point $t_2$ as is shown in FIG. 3 at (*b*), whereby the predetermined amount or volume of the ice pieces within the metering chamber 13 is dispensed into a cup or the like not shown. Thereafter, the discharge port shutter 9 and the metering chamber shutter 10 are actuated to their respective closed positions by means of the associated shutter open/close mechanisms 11 and 12, respectively, at a time point $t_3$.

In the case of the illustrated embodiments, the dispensing aperture of the metering or transient storage chamber 13 is provided horizontally at the bottom of the chamber. Accordingly, the ice pieces within the metering chamber 13 can drop immediately therebelow. Thus, the period $T_2$ during which the metering chamber shutter 10 is opened can be shortened to about 0.2 sec., by way of example. Consequently, even when both the discharge port shutter 9 and the metering chamber shutter 10 are opened, the possibility that the ice pieces be additionally fed outwardly from the discharge port 5c of the ice storage box 5 does not exist, whereby the dispensing of a predetermined amount of ice can be assured with enhanced reliability.

Figure 4A:
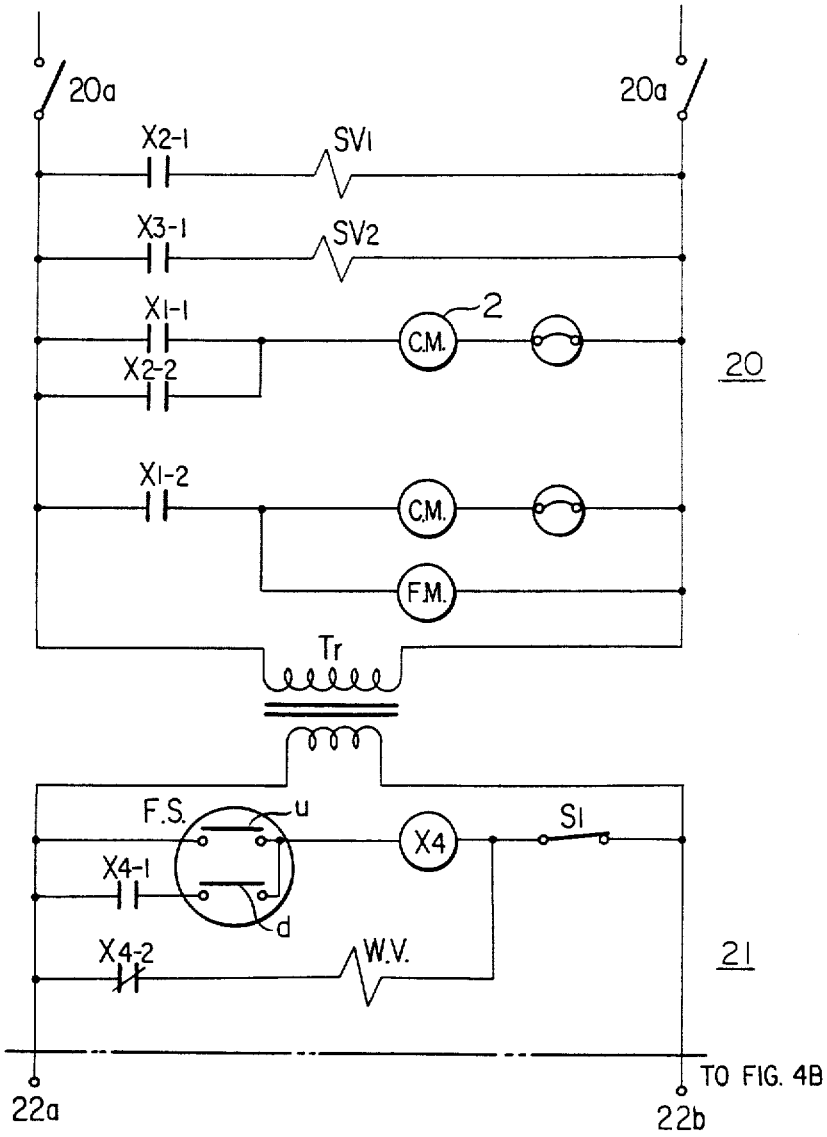
FIGS. 4A and 4B are schematic diagrams showing a wiring arrangement comprising various components of a control unit for controlling operations of the ice dispenser shown in FIG. 1.
Figure 4B:
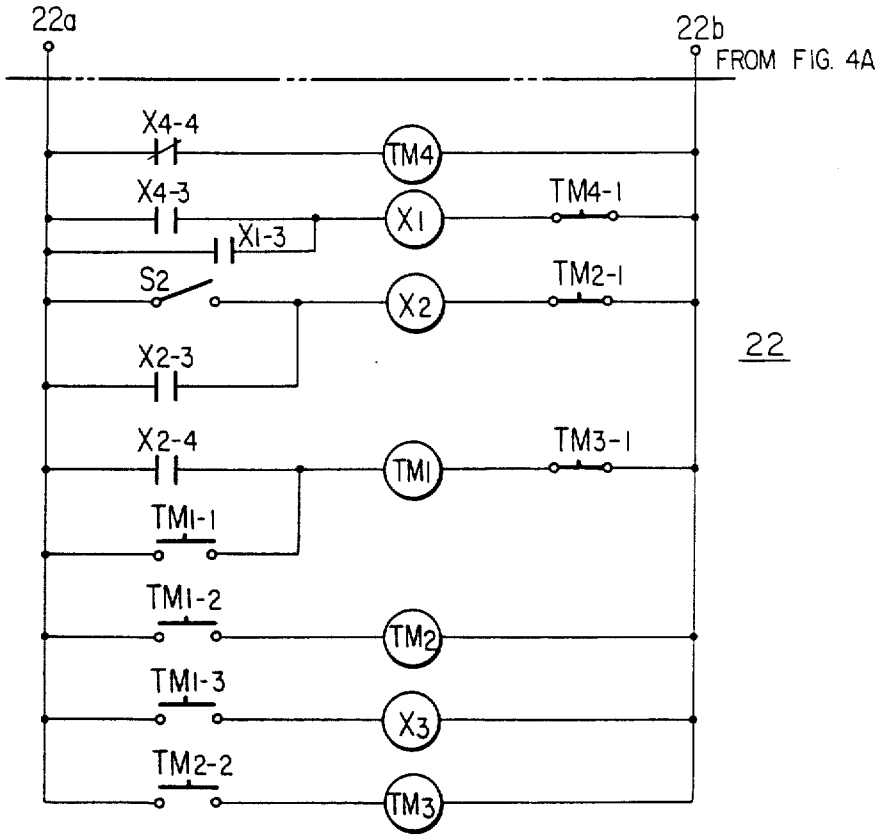

FIGS. 4A and 4B in combination show a circuit diagram of an operation control circuit for controlling operation of the ice dispenser apparatus described above with reference to FIGS. 1 and 2. The operation control circuit includes as major parts thereof high-voltage circuitry 20, low-voltage circuitry 21 and control circuitry 22. The high voltage circuitry 20 is comprised of a discharge port shutter driver $SV_1$ such as a solenoid actuator serving as the shutter open/close mechanism 11 for selectively opening and closing the discharge port shutter 9, a metering chamber shutter driver $SV_2$ such as a solenoid-type device serving as the shutter open/close actuator for selectively opening and closing the metering chamber shutter 10, the drive motor 2 mentioned before, the compressor CM also mentioned hereinbefore and a motor fan FM which are interconnected in the manner illustrated. The low-voltage circuitry 21 supplied with electric power from the high-voltage circuitry 20 through a transformer Tr is comprised of a float switch FS, an electromagnetic water valve WV, a fourth relay $X_4$ and contacts $S_1$ of the aforementioned ice storage sensor switch 14 which are interconnected in the manner illustrated. Referring in particular to FIG. 4B, the control circuitry 22 connected to the low-voltage circuitry 21 through terminals 22*a* and 22*b* includes a first relay $X_1$, a second relay $X_2$, a third relay $X_3$, a first timer $TM_1$, a second timer $TM_2$, a third timer $TM_3$, a fourth timer $TM_4$ and an ice discharging switch $S_2$ which are interconnected in a manner as illustrated.

Figure 5:
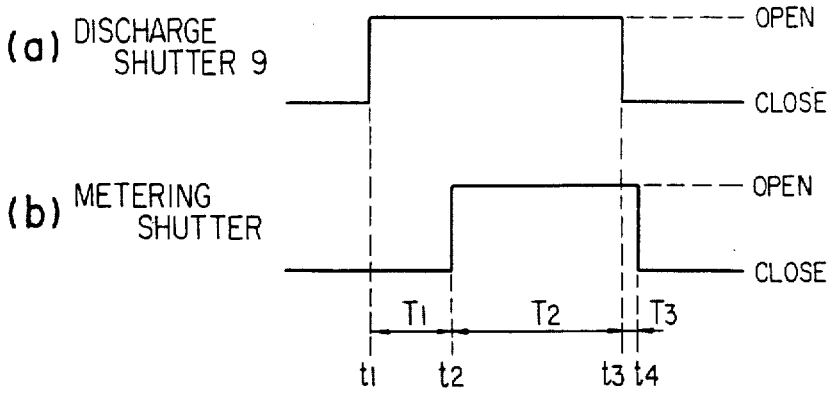
FIG. 5 is a timing chart illustrating shutter operations of the discharge port shutter and the metering chamber shutter performed under the control of the control unit shown in FIGS. 4A and 4B.

Next, an ice discharging or dispensing operation performed under control of the control circuit mentioned above will be described by also referring to a timing chart illustrated in FIG. 5. At first, a power source switch 20a is closed, whereupon the electromagnetic water valve WV is electrically energized through a normally closed contact $X_{4\text{-}2}$ of the relay $X_4$ to allow water to be fed to a water tank (not shown). When the water level within the water tank has attained a preset upper limit, the upper limit contact u of the float switch FS is closed to electrically energize the fourth relay $X_4$ which is then maintained in a self-holding state through the cooperation of the lower limit contact d of the float switch FS already closed and the normally opened contact $X_{4\text{-}1}$ of the fourth relay $X_4$, while the normally closed contact $X_{4\text{-}2}$ thereof is opened to interrupt the water supply to the water tank. Furhtermore, since the normally opened contact $X_{4\text{-}3}$ of the fourth relay $X_4$ is closed, the first relay $X_1$ is electrically energized, whereby both of the normally opened contacts $X_{1\text{-}1}$ and $X_{1\text{-}2}$ are simultaneously closed to energize the drive motor 2 and the compressor CM, whereupon the ice making operation of the ice dispenser apparatus is started. When the amount of water contained within the water tank is lowered, as the ice making operation proceeds, until the lower limit water level is ultimately reached, the lower limit contact d is opened, whereupon the fourth relay $X_4$ is deenergized to restart the water supply to the water tank. The first relay $X_1$ is maintained in a self-holding state for a period set by the fourth timer $TM_4$, which period is at least long enough that the water level in the tank attains the upper limit for closing the upper limit contact u of the float switch FS to thereby energize the fourth relay $X_4$. Consequently, during this period, the ice making operation is continued. The ice pieces thus produced are stored in the ice storage box 5. When the upper limit contact u of the float switch FS is not closed upon lapse of the time set by the timer $TM_4$ due to a halt in the water supply from the water service system or the like, the first relay $X_1$ is released from the self-holding state in response to the opening of the contact $TM_{4\text{-}1}$ of the fourth timer $TM_4$, whereupon both the compressor CM and the drive motor 2 are electrically deenergized to thereby cause the ice making operation to be stopped. In this way, the ice dispenser apparatus is safeguarded. On the other hand, when a sufficient amount of the ice pieces has been stored within the ice storage box 5, the contact $S_1$ of the ice storage level sensor switch 14 incorporated in the high-voltage circuitry 21 is opened, in response to which the ice-making operation and the water supply operation are interrupted.

When the ice pieces are to be dispensed from the storage box 5, a period of time is set by the second timer $TM_2$ that corresponds to the amount of ice pieces to be discharged, which is followed by actuation of the ice discharging switch $S_2$. The setting of the second timer $TM_2$ can be manually performed through any appropriate setting means such as a knob or the like. When the ice discharging switch $S_2$ is manipulated, the second relay $X_2$ is electrically energized and set to the self-holding state due to the closing of the normally opened contact $X_{2-3}$ of the second relay $X_2$. The normally opened contacts $X_{2-1}$, $X_{2-2}$ and $X_{2-4}$ of the second relay are also closed. When the contacts $X_{2-1}$ and $X_{2-2}$ are closed in this manner, the solenoid device $SV_1$ serving as the discharging port shutter open/close actuator 11 and the drive motor 2 for driving the agitator assembly 6 start respective operations at the time point $t_1$ shown in FIG. 5 at (*a*), whereby a portion of the ice pieces contained within the ice storage box 5 is discharged into the transient storage or metering chamber 13. Additionally, the first timer $TM_1$ is activated in response to the closing of the contact $X_{2-4}$. When a time $T_1$, which is so selected as to allow the metering chamber 13 to be fully filled with the ice pieces discharged from the ice storage box 5, has elapsed at a time point $t_2$, the contacts $TM_{1-1}$, $T_{1-2}$ and $TM_{1-3}$ of the first timer $T_1$ are closed. When the contact $T_{1-1}$ is closed, the first timer $TM_1$ is set to the self-holding state, while the second timer $TM_2$ is activated in response to the closing of the contact $TM_{1-2}$ with the third relay $X_3$ being energized in response to the closing of the contact $TM_{1-2}$. When the third relay $X_3$ is energized, the normally opened contact $X_{3-1}$ thereof is closed to energize the solenoid device $SV_2$ serving as the metering chamber shutter actuating means, whereby the metering chamber shutter 10 is opened to allow the ice pieces to be dispensed from the transient storage or metering chamber 13, as is illustrated in FIG. 5 at (*b*). When a predetermined time $T_2$ set by the second timer $TM_2$ by convenient setting means (not shown) has elapsed at a timer point $t_3$, the contact $TM_{2-1}$ is opened with the contact $TM_{2-2}$ being closed. In response to the opening of the contact $TM_{2-1}$, the second relay $X_2$ is released from the self-holding state, whereupon the solenoid device $SV_1$ and the drive motor 2 are deenergized to stop the operation of the agitator assembly 6 on one hand and to close the discharging port shutter 9 on the other hand. The ice dispensing operation now ends. In this way, the ice pieces can be dispensed from the metering chamber 13 in an amount corresponding to the time or period $T_2$ spanning the time points $t_2$ and $t_3$ during which the discharge port shutter 9 of the ice storage box 5 is maintained in the opened state. Additionally, when the contact $TM_{2-2}$ is closed, the third timer $T_3$ is activated, whereby the contact $TM_{3-1}$ is opened at a time point $t_4$ after the lapse of a short time $T_3$ beginning from the activation of the third timer $TM_3$. As a result, the first timer $TM_1$ is released from the self-holding state to thereby cause the third relay $X_3$ to be deenergized, whereby the solenoid device $SV_2$ serving as the metering chamber shutter actuator 12 is deactivated to thereby close the metering chamber shutter 10, as will be seen in FIG. 5 at (*b*). Due to a short time span or delay between the time points at which the discharge port shutter 9 and the metering chamber shutter 10 are closed, respectively, the ice pieces can be prevented not only from being clamped by the metering chamber shutter member 10 but also from being left within the metering chamber 13.

Figure 6A:
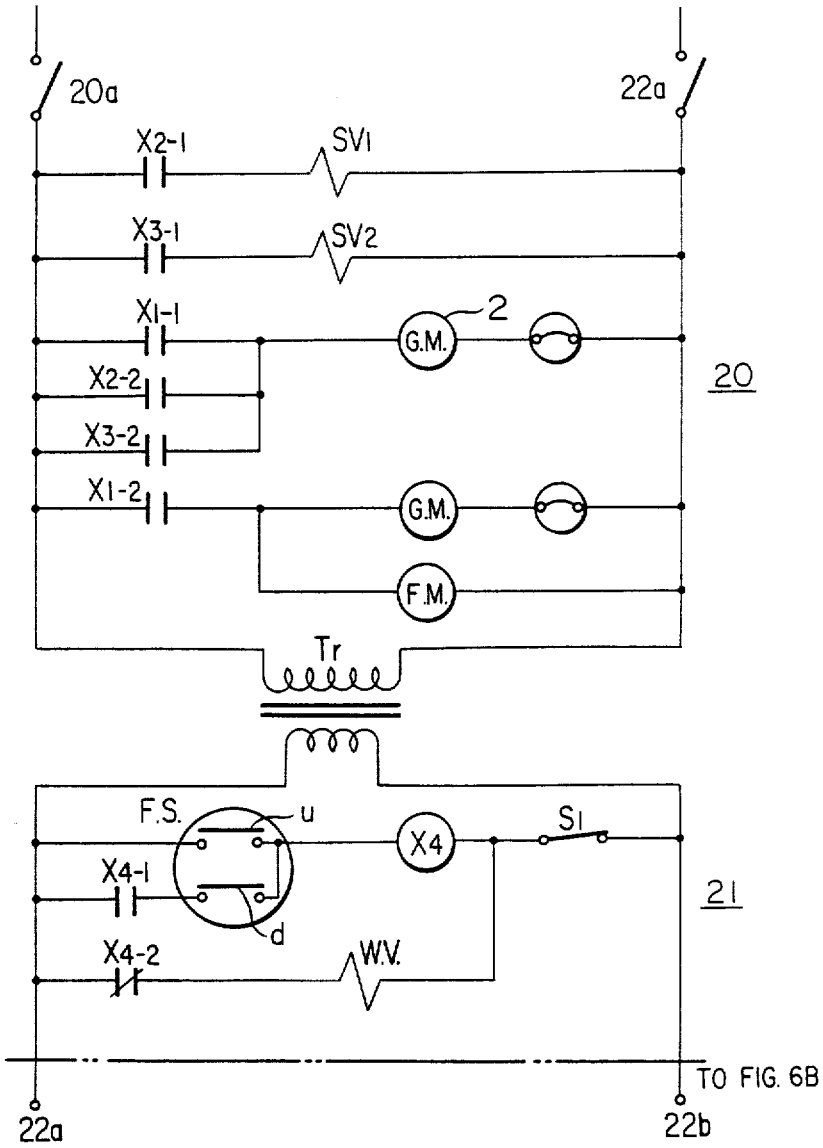
FIGS. 6A and 6B are schematic diagrams showing a circuit arrangement comprising various components of another control unit which can also be employed for controlling the ice dispenser apparatus shown in FIGS. 1 and 2.
Figure 6B:
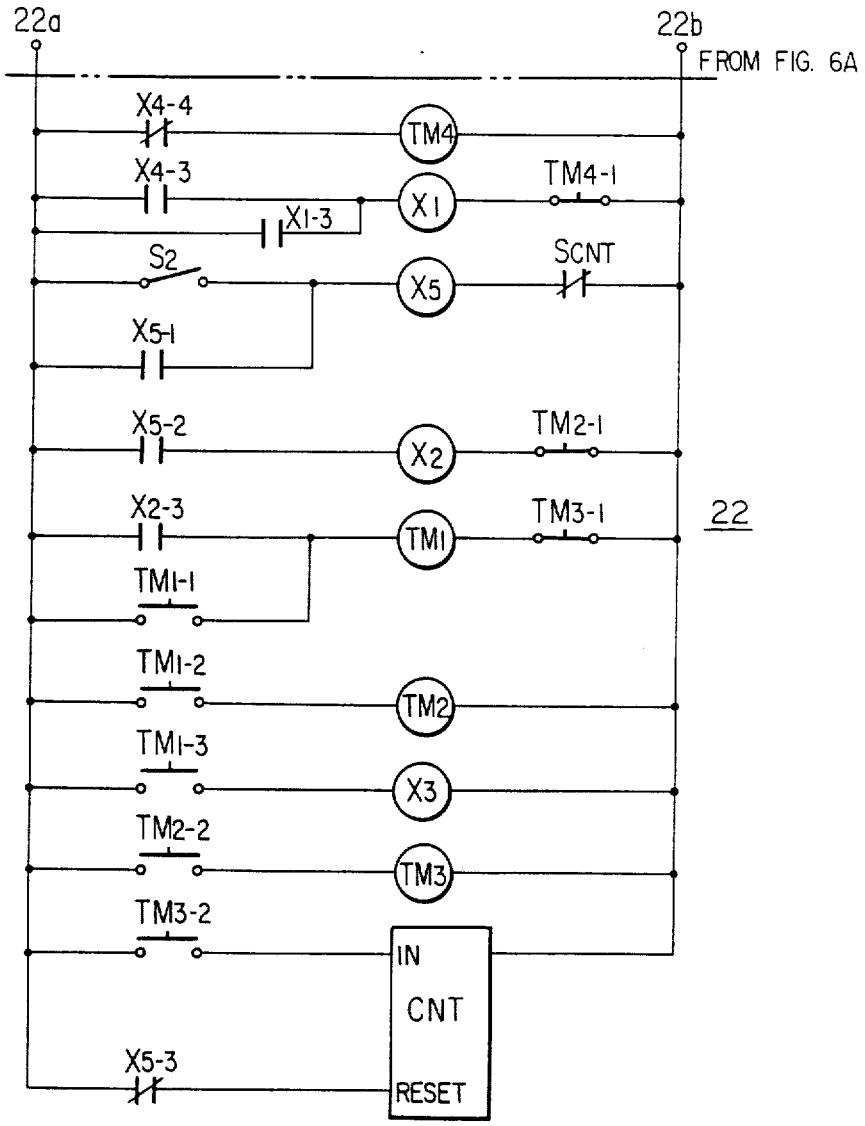

FIGS. 6A and 6B in combination show another exemplary embodiment of the control circuit which differs from the one shown in FIGS. 4A and 4B in that the normally opened contact $X_{3-2}$ of the relay $X_3$ incorporated in the high-voltage circuitry 20 is connected in series to the drive motor 2 and in that a fifth relay $X_5$ and a counter CNT as well as the associated contacts are provided in the control circuitry 22.

In the ice dispenser apparatus equipped with the control circuit shown in FIGS. 6A and 6B, the number of times the ice discharging operation is to be performed repeatedly depending on the desired amount of ice to be dispensed is first set in the counter CNT by a convenient setting means such as a knob or the like (not shown).

When the ice discharging switch $S_2$ is operated after the above-mentioned number of times has been set, the fifth relay $X_5$ serving to hold the ice discharging operation is energized and set to the self-holding state in response to the closing of the normally opened contact $X_{5-1}$ of the fifth relay. The normally opened contact $X_{5-2}$ of the fifth relay is closed while the normally closed contact $X_{5-3}$ thereof is opened.

When the normally closed contact $X_{5-3}$ of the fifth relay $X_5$ is thus opened, the signal input to the reset terminal of the counter CNT ceases, whereby the counter CNT assumes a state capable of counting the number of times a pulse is applied to the input terminal In. Furthermore, the closing of the normally open contact $X_{5-2}$ of the fifth relay is accompanied by energization of the second relay $X_2$ for enabling the ice discharging operation, whereby the normally open contacts $X_{2-1}$, $X_{2-2}$ and $X_{2-3}$ of the second relay $X_2$ are closed.

Figure 7:
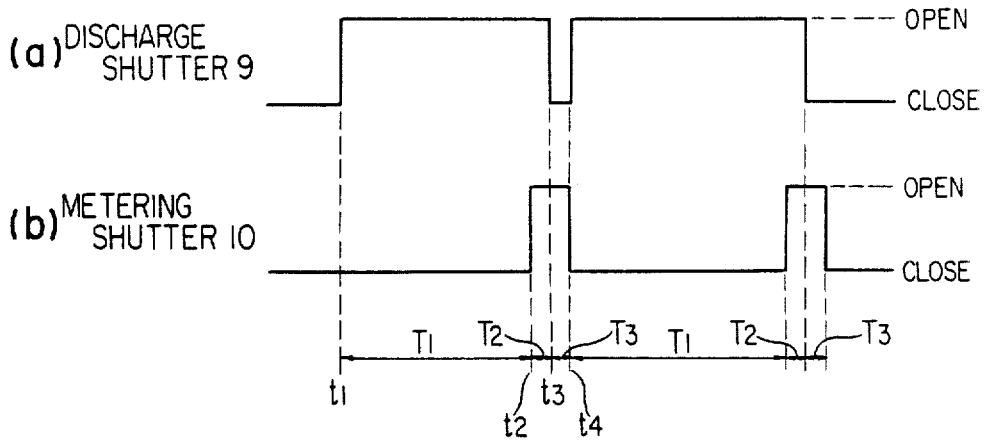
FIG. 7 is a timing chart illustrating operations of the discharge port shutter and the metering chamber shutter performed under the control of the control unit shown in FIGS. 6A and 6B.

In response to the closing of the contacts $X_{2-1}$ and $X_{2-2}$, the discharge port shutter(9) driving device $SV_1$ and the motor 2 for driving the agitator assembly 6 are actuated, respectively, at a time point $t_1$ shown in FIG. 7 at (*a*), whereby a portion of the ice pieces is discharged into the metering chamber 13 from the ice storage box 5. Additionally, the first timer $TM_1$ is activated in response to the closing of the contacts $X_{2-3}$. The contact $TM_{1-1}$, $TM_{1-2}$ and $TM_{1-3}$ of the first timer $TM_1$ are closed at a time point $t_2$ after the lapse of a period $T_1$ which is set long enough for the metering chamber 13 to become filled with the ice pieces.

When the contact $TM_{1-1}$ of the first timer is closed, the first timer $TM_1$ is set to the self-holding state, while the second timer $TM_2$ is triggered when the contact $TM_{1-2}$ is closed with the third relay $X_3$ being energized in response to the closing of the contact $TM_{1-3}$ of the first timer.

When the third relay $X_3$ is energized, the normally opened contact $X_{3-1}$ thereof is closed to activate the metering chamber shutter actuator solenoid $SV_2$, whereby the metering chamber shutter 10 is opened to allow the ice pieces to be dispensed from the metering chamber 13, as will be seen in FIG. 7 at (*b*).

The contact $TM_{2-1}$ of the activated timer $TM_2$ is opened with the contact $TM_{2-2}$ being closed at a time point $T_2$ after a lapse of the time $T_2$ starting from the activation of the secnd timer $TM_2$.

When the contact $TM_{2-1}$ of the second timer $TM_2$ opens, the second relay $X_2$ is deenergized, whereby the discharge port shutter actuator $SV_1$ and the drive motor 2 are deenergized. Thus, the agitator assembly 6 is stopped with the discharge port shutter 9 being closed.

Additionally, when the contact $TM_{2-2}$ of the second timer $TM_2$ is closed, the third timer $TM_3$ is activated. After a lapse of a very short time $T_3$ starting from the activation of the third timer $TM_3$, the contact $TM_{3-1}$ is opened with the contact $TM_{3-3}$ being closed at a time point $T_4$.

When the contact $TM_{3-1}$ is opened, the first timer $TM_1$ is released from the self-holding state. Consequently, the contact $TM_{1-2}$ of this timer is opened, whereby the second timer $TM_2$ is deactivated. Furthermore, the contact $TM_{1-3}$ is opened to deenergize the third relay $X_3$, while the third timer $TM_3$ itself is also instantaneously deactivated in response to the opening of the contact $TM_{2-2}$. When the third relay $X_3$ is deenergized, the metering chamber shutter actuator $SV_2$ is also deenergized to allow the metering chamber shutter 10 to to be closed while the discharge port shutter 9 is again opened because the contact $TM_{2-1}$ is restored due to the deenergization of the second timer $TM_2$, as will be seen in FIG. 7 at (*b*). By interposing a short delay time $T_3$ between the closing of the discharge port shutter 9 and that of the metering chamber shutter 10, the ice pieces are prevented not only from being clamped by the metering chamber shutter sheet 10 but also from being left within the metering chamber 13.

Furthermore, when the contact $TM_{3-2}$ is closed, a signal is applied to the input terminal In of the counter CNT. Since the third timer $TM_3$ is deenergized immediately after having been energized as described above, the signal applied to the input terminal In through the contact $TM_{3-2}$ is naturally a needle-like pulse signal. In response to this pulse signal, the counter CNT is incremented to indicate that the ice dispensing operation has been performed once.

When the first timer $TM_1$ is released from the self-holding state, the second timer $TM_2$ is also deactivated to close the contact $TM_{2-1}$ thereof, whereupon the second relay $X_2$ for the ice discharge operation is again energized to allow the ice pieces to be transferred to the metering chamber for being subsequently dispensed. This operation may be repeated a number of times as desired.

In this manner, the ice discharging/dispensing operation is repeated until the number of the pulses produced by the contact $TM_{3-2}$ has attained the value preset in the counter CNT, whereupon the contact $S_{CNT}$ of the counter CNT is opened, resulting in that the fifth relay $X_5$ for holding the ice dispensing operation is released from the self-holding state. The ice dispensing operation now comes to an end.

In conjunction with the embodiment shown in FIG. 8, it should be noted that the opening/closing operations of the discharge port shutter and the metering chamber shutter may be controlled by either the control circuit shown in FIGS. 4A and 4B or the one shown in FIGS. 6A and 6B.

As will be appreciated from the foregoing description, the ice dispenser apparatus according to the present invention is so arranged that during an ice dispensing operation, the ice pieces discharged from the ice storage box are stored once in the metering or transient storage chamber in a predetermined amount and that the ice dispensing operation can be repeated a number of times depending on the amount of ice desired. With such an arrangement unevenness in the amount of dispensed ice can be suppressed to a minimum regardless of possible changes in the nature or quality and shape of the ice pieces to thereby ensure consistent ice dispensing operation performance of the ice dispenser apparatus. The apparatus according to the present invention can thus be applied to automatic vending machines or the like to facilitate a great advantage and effectiveness.

The invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

What we claim is:

1. An ice dispenser apparatus comprising:

an ice making mechanism for producing ice;

ice storage means operatively connected to said ice making mechanism for storing ice produced by said ice making mechanism, said ice storage means having a discharge port through which the ice stored in the ice storage means is discharged;

a discharge port shutter mounted over said discharge port and actuatable to an open position at which said discharge port is open thereby enabling the ice to be discharged therethrough and to a closed position at which said discharge port is closed;

a discharge port shutter actuating means operatively connected to said discharge port shutter for normally actuating said discharge port shutter to said closed position;

transient storage chamber means in communication with said discharge port for transiently storing a predetermined amount of the ice discharged through said discharge port, said transient storage chamber means having a bottom, a front, respective side portions, and an aperture through which ice transiently stored therein is dispensed, said aperture including respective portions defined, respectively, at the bottom and the front of said transient storage chamber means;

a transient storage chamber shutter movably mounted over said aperture for selectively opening and closing over said aperture, said transient storage chamber shutter comprising a pivotable L-shaped plate member having a bottom leg portion and an upstanding leg portion extending perpendicularly to said bottom leg portion, said bottom leg portion and said upstanding leg portion closing over said aperture portions, respectively, when said transient storage chamber shutter is closed over said aperture;

a transient storage chamber actuating means operatively connected to said transient storage chamber shutter for selectively opening and closing said discharge port shutter over said aperture; and control means operatively connected to said discharge port shutter actuating means and said transient storage chamber shutter actuating means for controlling the same to actuate said shutters in a manner in which said predetermined amount of ice is temporarily stored once within said transient storage chamber before being disposed through said aperture.

2. An ice dispenser apparatus as claimed in claim 1, wherein said ice making mechanism is an auger-type ice making mechanism comprising an auger.

3. An ice dispenser apparatus as claimed in claim 1, wherein said upstanding leg portion of said L-shaped plate member has a projection extending substantially horizontally into said transient storage chamber means.

4. An ice dispenser apparatus comprising:

an ice making mechanism for producing ice;

ice storage means operatively connected to said ice making mechanism for storing the ice produced by said ice making mechanism, said ice storage means having a discharge port through which the ice stored in the ice storage means is discharged;

a discharge port shutter mounted over said discharge port and actuatable to an open position at which said discharge port is open thereby enabling ice to be discharged therethrough and to a closed position at which said discharge port is closed;

a discharge port shutter actuating means operatively connected to said discharge port shutter for actuating said discharge port shutter;

transient storage chamber means in communication with said discharge port for transiently storing a predetermined amount of the ice discharged through said discharged port, said transient storage chamber means having an aperture, through which ice transiently stored therein is dispensed;

a transient storage chamber shutter movably mounted over said aperture for opening and closing over said aperture;

a transient storage chamber actuating means operatively connected to said transient storage chamber shutter for actuating said transient storage chamber shutter to selectively open and close over said aperture;

control means operatively connected to said discharge port shutter actuating means and to said transient storage chamber shutter actuating means for performing a controlling operation in which said actuating means are controlled to actuate said shutters in a manner in which a predetermined amount of ice is dispensed through said aperture;

a manipulatable ice discharge switch operatively connected to said control means for actuating said control means to perform said controlling operation when said switch is once manipulated; and setting means operatively connected to said control means for setting the amount of ice dispensed during the controlling operation performed by said control means to said predetermined amount, said setting means being adjustable for varying said predetermined amount.

5. An ice dispensing apparatus as claimed in claim 4, wherein said control means includes a relay energized by manipulation of said ice dispensing switch for controlling said discharge port shutter actuating means to actuate said discharge port shutter to said open position;

a first timer connected to said relay and activated when said relay is energized to activate said transient storage chamber shutter actuating means to in turn open said transient storage chamber shutter over said aperture after the lapse of a delay time that is long enough for the predetermined amount of ice pieces to be stored within said transient storage chamber; and a second timer operatively connected to said setting means and activated after said delay time has lapsed for establishing an opening period during which said discharge port shutter is open and said transient storage chamber shutter is open over said aperture based on the adjustment of said setting means, said second timer controlling said discharge port shutter actuating means and said transient storage chamber shutter actuating means to actuate said discharge port shutter to said closed position and to close said transient storage chamber shutter over said aperture after said opening period based on the adjustment of said setting means has lapsed.

6. An ice dispensing apparatus as claimed in claim 4, wherein said control means includes a relay energized by manipulation of said ice dispensing switch for controlling said discharge port shutter actuating means to actuate said discharge port shutter to said open position;

a first timer connected to said relay and activated when said relay is energized to activate said transient storage chamber shutter actuating means to in turn open said transient storage chamber shutter over said aperture after the lapse of a delay time that is long enough for the predetermined amount of ice pieces to be stored within said transient storage chamber;

a second timer operatively connected to said setting means and activated after said delay time has lapsed for establishing an opening period during which said discharge port shutter is open and said transient storage chamber shutter is open over said aperture based on the adjustment of said setting means, said second timer controlling said discharge port shutter actuating means to actuate said discharge port shutter to said closed potion after said opening period, based on the adjustment of said setting means, has lapsed; and a third timer energized when said opening period lapses, said third timer establishing a short time period, and said transient storage chamber shutter actuating means being controlled to close said transient storage chamber shutter over said aperture when said short time period has lapsed.

7. An ice dispensing apparatus as claimed in claim 4, and further comprising agitating means disposed within said ice storage means for agitating the ice stored therein to urge the ice toward the discharge port of said ice storage means and therethrough when said discharge port is open, and wherein said ice discharge switch is operatively connected to said agitating means for causing said agitating means to begin agitating ice when said ice discharge switch is manipulated.

8. An ice dispenser apparatus comprising:

an ice making mechanism for producing ice;

ice storage means operatively connected to said ice making mechanism for storing the ice produced by said ice making mechanism, said ice storage means having a discharge port through which the ice stored in the ice storage means is discharged;

a discharge port shutter mounted over said discharge port and actuatable to an open position at which said discharge port is open thereby enabling ice to be discharged therethrough and to a closed position at which said discharge port is closed;

a discharge port shutter actuating means operatively connected to said discharge port shutter for actuating said discharge port shutter;

transient storage chamber means in communication with said discharge port for transiently storing a predetermined amount of the ice discharged through said discharge port;

said transient storage chamber means having an aperture through which ice transiently stored therein is dispensed;

a transient storage chamber shutter movably mounted over said aperture for opening and closing over said aperture;

a transient storage chamber actuating means operatively connected to said transient storage chamber shutter for actuating said transient storage chamber shutter to selectively open and close over said aperture;

control means operatively connected to said discharge port shutter actuating means and to said transient storage chamber shutter actuating means for performing a controlling operation in which said actuating means are controlled to actuate said shutters in a manner in which a predetermined amount of ice is dispensed through said aperture;

a manipulatable ice discharge switch operatively connected to said control means for actuating said control means to perform said controlling operation a predetermined number of times when said switch is once manipulated; and setting means operatively connected to said control means for setting the number of times that said control means performs said controlling operation, when actuated by the single manipulation of said ice discharge switch, to said predetermined number of times;

said setting means being adjustable for changing the predetermined number of times that said control means performs said controling operation, when said control means is actuated by the manipulation of said switch.

9. An ice dispensing apparatus as claimed in claim 8, wherein said control means includes counter means for counting the number of times the predetermined amount of ice is actually dispensed from said transient storage chamber means, said counter means operatively connected to said setting means for stopping the dispensing of the ice when the number of times set by said setting means coincides with the number of times the ice has been actually dispensed;

an ice dispensing operation holding relay energized by the manipulation of said ice discharging switch means to be set to a self-holding state for allowing the dispensing of the ice to be performed the predetermined number of times set by said setting means;

an ice discharging operation activating relay energized in response to the energization of said ice dispensing operation holding relay to control said discharge port shutter actuating means to actuate said discharge port shutter to said open position;

a first timer activated by said ice discharge operation activating relay for opening said transient storage chamber shutter over said aperture by activating said transient storage chamber shutter actuating means after the lapse of a delay time that is long enough for said transient storage chamber means to be filled with the ice;

a second timer activated successively with respect to the activation of said first timer, said second timer controlling said discharge port shutter actuating means to actuate said discharge port shutter to said closed position after the lapse of an ice dispensing time that is long enough for the amount of ice transiently stored in said transient storing chamber means to be dispensed; and a third timer activated after said ice dispensing time has lapsed in succession to the activation of said second timer for controlling said transient storage chamber shutter actuating means to close said transient storage chamber shutter over said aperture while actuating said discharge port shutter to said open position by again actuating said discharge port shutter actuating means and for issuing a signal to said counter indicative of that of a single said controlling operation has been performed.

10. An ice dispensing apparatus as claimed in claim 8, and further comprising agitating means disposed within said ice storage means for agitating the ice stored therein to urge the ice toward the discharge port of said ice storage means and therethrough when said discharge port is open, and wherein said ice discharge switch is operatively connected to said agitating means for causing said agitating means to begin agitating ice when said ice discharge switch is manipulated.

* * * * *